US006694584B1

(12) United States Patent
Ahrens

(10) Patent No.: US 6,694,584 B1
(45) Date of Patent: Feb. 24, 2004

(54) QUICK SET UP WIRE DESCALER

(75) Inventor: Matthew C. Ahrens, Malta, IL (US)

(73) Assignee: Rockford Manufacturing Group, Inc., South Beloit, IL (US)

( * ) Notice: Subject to any disclaimer, the term of this patent is extended or adjusted under 35 U.S.C. 154(b) by 0 days.

(21) Appl. No.: 10/211,745

(22) Filed: Aug. 2, 2002

(51) Int. Cl.[7] ..... B21B 45/04

(52) U.S. Cl. ..... 29/81.01; 29/81.04; 254/400; 72/183; 72/289

(58) Field of Search ..... 29/81.01, 81.03, 29/81.04, 81.05, 81.13, 81.17; 254/394, 395, 396, 398, 400; 242/615.1, 615.2, 615.3; 72/78, 160, 183, 274, 289; 226/189, 190, 194, 195

(56) References Cited

U.S. PATENT DOCUMENTS

| | | | | | |
|---|---|---|---|---|---|
| 3,184,825 | A | * | 5/1965 | Jones | 29/81.03 |
| 3,605,469 | A | * | 9/1971 | Queralto | 72/128 |
| 3,924,428 | A | * | 12/1975 | Noe | 72/40 |
| 4,917,285 | A | * | 4/1990 | Shosie | 228/5.7 |
| 5,097,688 | A | * | 3/1992 | Taylor et al. | 72/5 |
| 6,000,656 | A | * | 12/1999 | Taylor et al. | 242/418.1 |
| 6,109,082 | A | * | 8/2000 | Taylor et al. | 72/14.8 |

FOREIGN PATENT DOCUMENTS

GB 2109280 A * 6/1983

OTHER PUBLICATIONS

Rockford Manufacturing Group, Inc., *RMG Mechanical Descalers*, May 2000, p. 3.1.

Rockford Manufacturing Group, Inc., *RMG MD–10 Descaler Attachment and MD–10 Descaler Set–up*, May 2000, pp. 3.2, 3.3.

Rockford Manufacturing Group, Inc., *RMG MD–14 Descaler Attachment and MD–14 Descaler Set–up*, May 2000, pp. 3.4, 3.5.

* cited by examiner

*Primary Examiner*—David P. Bryant
*Assistant Examiner*—Jermie E. Cozart
(74) *Attorney, Agent, or Firm*—Leydig, Voit & Mayer, Ltd.

(57) ABSTRACT

A descaler is provided for descaling the scale on hot finished wire or green rod. The descaler comprises two rollers that are mounted to a rotatable support plate. The support plate and the rollers rotate in unison. One of the rollers pivots relative to the support plate such that the rollers can be positioned substantially parallel to allow wire to be easily fed between the rollers for set up purposes and can be positioned substantially perpendicular in which the rollers are arranged to effect wire descaling when wire is pulled through the descaler. Rotation of the roller support plate from the initial set up position automatically pivots the one roller into the working position. The pivoting movement of the one roller is accomplished using the tension of the wire that is created as the roller support plate is rotated and/or a cam mechanism.

21 Claims, 13 Drawing Sheets

QUICK SET UP WIRE DESCALER

FIELD OF THE INVENTION

The present invention relates generally to descalers for descaling the scale on wire which occurs as an undesirable byproduct in the manufacture of hot finished wire or "green rod", and more particularly to the initial wire set up of such descalers at a location upstream of a wire drawing machine or other wire consumption machine.

BACKGROUND OF THE INVENTION

Hot finished wire (also known as "green rod") is a desirable material used in many commercial applications. Although hot finished wire has certain desirable characteristics in comparison to other types of wire, the commercial manufacturing process for producing hot finished wire creates scale as an undesirable byproduct on the exterior surface of the wire (also known as "mill scale"). It is usually desirable to remove the scale on the wire for a number of reasons including aesthetics.

Descalers are frequently used at an upstream location of wire consumption operations (e.g. wire cutting machines) to remove the scale on the hot finished wire prior to use. Often times, these descalers are located upstream of a wire drawing machine. The wire drawing machine includes a capstan and drawbox for reducing the diameter of the wire. Wire drawing machines are generally disclosed in U.S. Pat. No. 4,917,285 to Shosie; U.S. Pat. No. 5,097,688 to Taylor et al.; U.S. Pat. No. 6,000,656 to Taylor et al.; and U.S. Pat. No. 6,109,082 to Taylor, et al; the entire disclosures of which are hereby incorporated by reference. Descalers often have a mounting flange that mounts directly along the upstream side of such wire drawing machines.

To descale the wire, wire descalers commonly have a pair of sheaves or rollers that are arranged along generally perpendicular axes of rotation. As wire is pulled through the descaler, one roller alternately stretches and contracts the opposing top and bottom surfaces of the wire while the other roller alternately stretches and contracts the opposing lateral side surfaces of the wire. The perpendicular arrangement of the rollers ensures that the outer surface of the wire is effectively stretched, contracted or bent in substantially all directions. Because scale is brittle, the bending of the wire in two different directions causes the scale to fall off the wire and thereby leaves a more desirable exterior finish on the wire. Each roller also typically includes a carbide hub insert at the inner radial periphery of the roller for wear resistance and to engage the wire to assist in scale removal.

During wire drawing operations when an active wire coil is being consumed, the wire descaler works automatically to descale the wire as it is pulled through the descaler. However, once the active wire coil is consumed, the problem arises that the leading end of a new wire coil must be fed through the complex looped path created by the perpendicularly oriented and horizontally spaced rollers of the wire descaler. In the past, set up of wire descalers has been a laborious task requiring extensive manual manipulation of the wire to wind the wire through the rollers of the descalers.

Two commercially available descalers include the RMG MD-10 Descaler Attachment and the RMG MD-14 Descaler Attachment, both manufactured by Rockford Manufacturing Group, Inc., the assignee of the present invention. Both of these descalers have been successful in descaling wire utilizing perpendicularly oriented sheaves or rollers.

In the MD-10 Descaler, the rollers are arranged at fixed positions in perpendicular orientation to each other. Set up of this descaler is accomplished by manually pulling wire through the descaler inlet, manually looping wire around the forward roller, manually bending the wire rearwardly toward the rear roller, and then underneath and around the rear roller and back forward through the descaler outlet. Since all of the bends and loops in the wire are performed manually, it will be readily appreciated by those skilled in the art that this is a fairly laborious task. Even if a worker uses sufficiently long strands of wire to provide additional leverage for wire easier bending, set up of this descaler is still a time consuming task and requires a significant amount of manual effort and skill.

The RMG MD-14 Descaler may be used with heavier wire gauges as compared with the MD-10 Descaler. In the MD-14 Descaler, one of the rollers is movable while the other roller is secured in a fixed position. In the MD-14 Descaler, the rollers are initially spaced horizontally with parallel vertical axes of rotation. To set up this descaler, wire is first pulled through the inlet and the outlet of the descaler and is threaded between the two rollers. A pry bar is often used to align and position the wire among and between the two rollers. The leading end of the wire is then typically pulled through a drawbox and secured to a gripper chain to prevent the wire from back feeding through the outlet during initial set up. After the wire is properly positioned between the rollers, a worker uses a pry bar to manually rotate the movable roller and its support assembly horizontally about and relative to the fixed position roller such that the movable roller is rotated in a semi-circle from the outlet end around the fixed position roller to the inlet end of the descaler. The pry bar is inserted into two different holes to accomplish this semi-circle of rotation. Once the movable roller reaches the inlet end of the descaler, its support assembly locks into position. Then, a worker manually raises and pivots the movable roller upward with the pry bar until the rotational axis of the movable roller is perpendicular to the axis of the fixed position roller. Finally, the wire running through the inlet end must then be manually repositioned to allow for insertion of the vertical guide rollers that typically are provided at the inlet end. Although the set up of the MD-14 reduces the manual handling of the wire, it still requires several different steps of manual effort to set up the descaler. As such, set up of this descaler is still a time consuming task and requires a significant amount of manual effort and skill.

The set up of the MD-14 and the MD-10 descalers are described in further detail in brochures entitled the "RMG MD-10 Descaler Attachment" and the "RMG MD-10 Descaler Attachment", both dated May, 2000, and available from Rockford Manufacturing Group, Inc. Further detail can be had to those references for further details on the wire set up those machines.

BRIEF SUMMARY OF THE INVENTION

In view of the foregoing, it is a general objective of the present invention to provide a descaler for descaling scale on wire that is easier to set up.

It is another objective of the present invention to provide a descaler having a setup that may be substantially automated.

In accordance with these and other objectives, the present invention is directed toward a wire descaler in which rotation of one or more of the rollers about an offset axis automatically translates the rollers from a set up position in which the rollers are aligned along substantially parallel axes of rotation to a working position in which the rollers are aligned along substantially perpendicular axes of rotation.

According to one aspect of the present invention, a descaler comprises two rollers that are mounted to a rotatable support plate. The support plate and the rollers rotate in unison relative to a housing through rotational input provided along a drive shaft. The drive shaft is journalled in a bearing support housing which is mounted to the housing. At least one of the rollers pivots relative to the support plate. The rollers are movable between a set up position in which axes of the rollers are substantially parallel to provide for feeding of wire through the rollers and a working position in which the axes of the rollers are substantially perpendicular to effect wire descaling during operation when wire is pulled through the descaler. Rotation of the roller support plate from the initial set up position automatically pivots the rollers into the working position. Translation of the rollers from the set up position to the working position may be accomplished using the tension of the wire that is created as the roller support plate is being rotated, a cam mechanism, or a combination thereof.

DETAILED DESCRIPTION OF THE INVENTION

Figure 1:
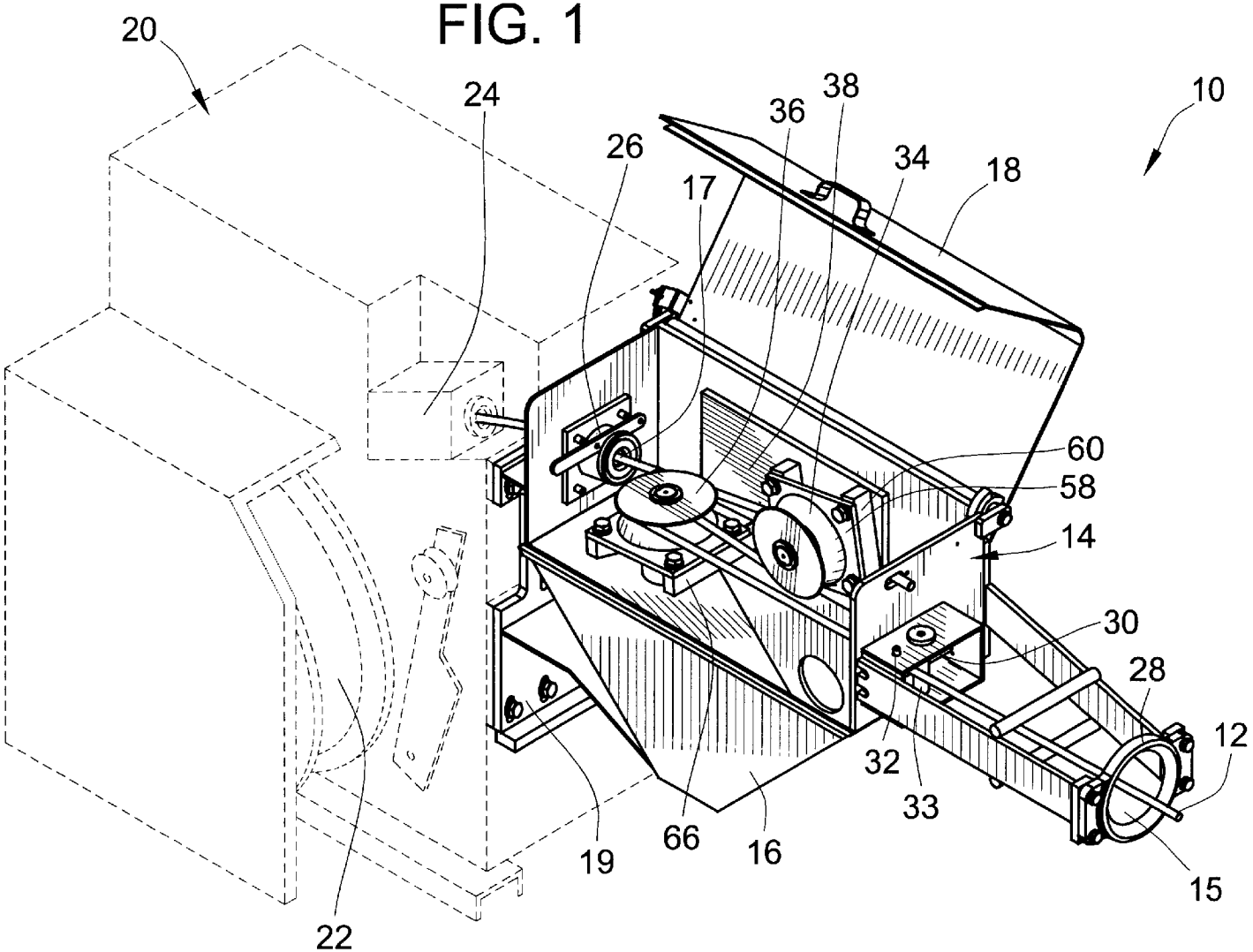
FIG. 1 is an isometric view of a wire descaler according to a preferred embodiment of the present invention.

Referring to the drawings, an embodiment of the present invention is illustrated as a descaler 10 for descaling the scale occurring on the exterior surface of hot finished wire 12 (also known as "green rod" in the industry). The descaler 10 includes a housing 14 having an inlet 15 for receiving scaled wire and an outlet 17 for outputting descaled wire during operation. The descaler housing 14 may include a hopper 16 to provide for collection of removed scale and a cover plate 18 that may be pivoted opened to allow for set up or closed to provide a shield against rotating components of the descaler. The housing 14 may also include a mounting flange 19 that can be fastened to a wire drawing machine 20.

As shown in FIG. 1, the descaler 10 is typically positioned and mounted on the upstream side of a wire drawing machine 20 between the wire drawing machine 20 and a wire coil (not shown). The wire drawing machine 20 includes a capstan 22 and a drawbox 24 for reducing the diameter of the wire 12. The capstan 22 typically includes a gripper mechanism (not shown) that can be secured to the leading end of the wire to secure the wire and provide a means for initially pulling the wire through the drawbox 24 and wrapping the wire about the capstan 22.

Figure 2:
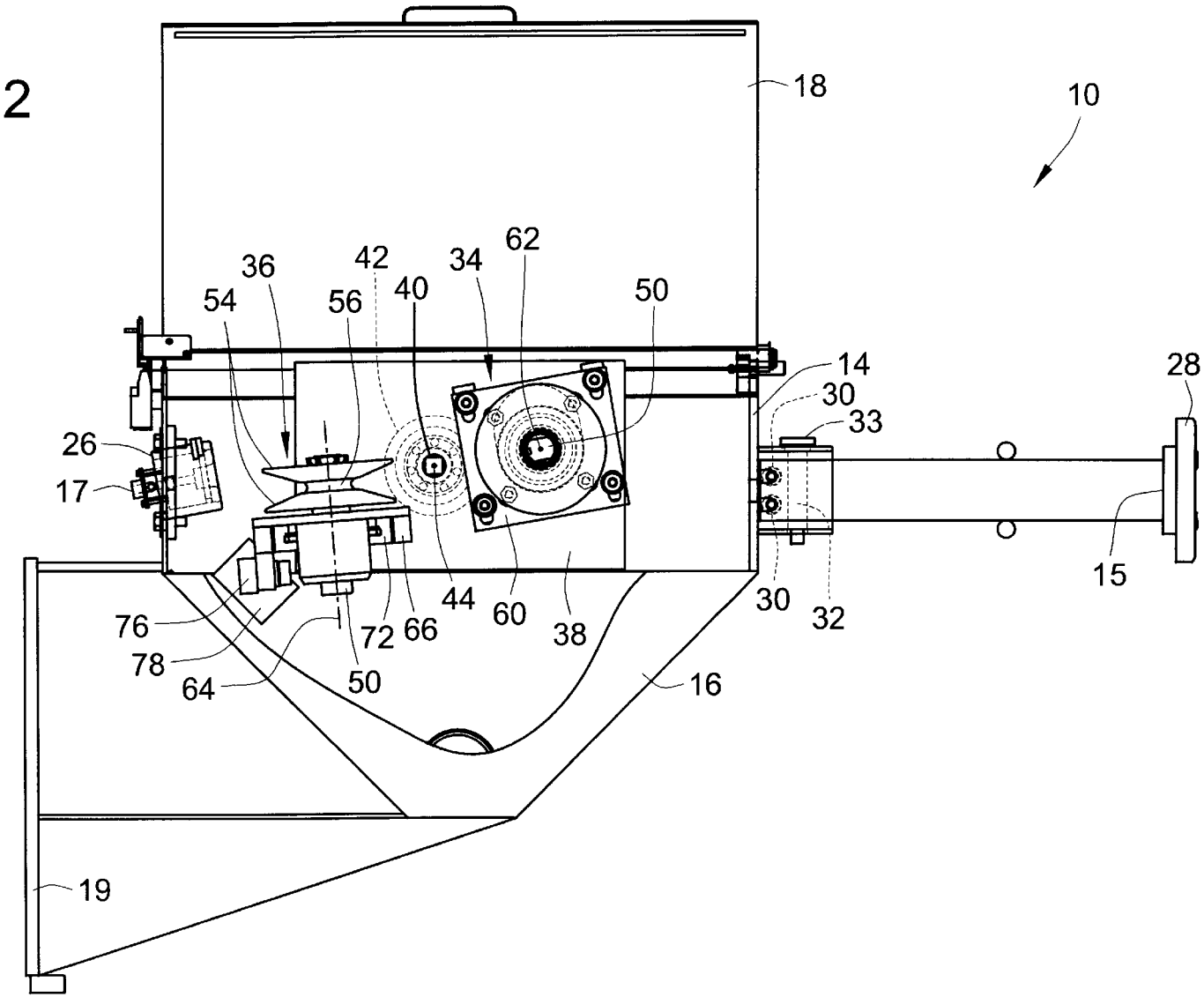
FIGS. 2–4 are front elevation, side and plan views of the wire descaler shown in FIG. 1.

When the descaler 10 is mounted to the wire drawing machine 20, the outlet 17 of the descaler 10 aligns substantially with the drawbox 24. The inlet 15 of the wire descaler 10 is positioned to receive wire from a wire coil. A pneumatic air wipe assembly 26 may be provided at the descaler outlet 17 to provide a means for blowing off residual scale dust remaining on the wire. At the descaler inlet 15, wire may first be directed first through a large guide ring 28 having a large opening for providing rough orientation for the wire, and then through pairs of horizontal guide rolls 30 and vertical guide rolls 32, 33 that have a smaller opening therebetween for more precise orientation of the wire 12. One or both of the vertical guide rolls is removable to provide a larger opening for easier insertion of leading wire ends into the descaler 10. In the disclosed embodiment, the vertical guide roll identified at reference number 33 as shown in FIGS. 1 and 2 may be pulled out to allow for easier insertion of wire into the descaler 10.

Figure 3:
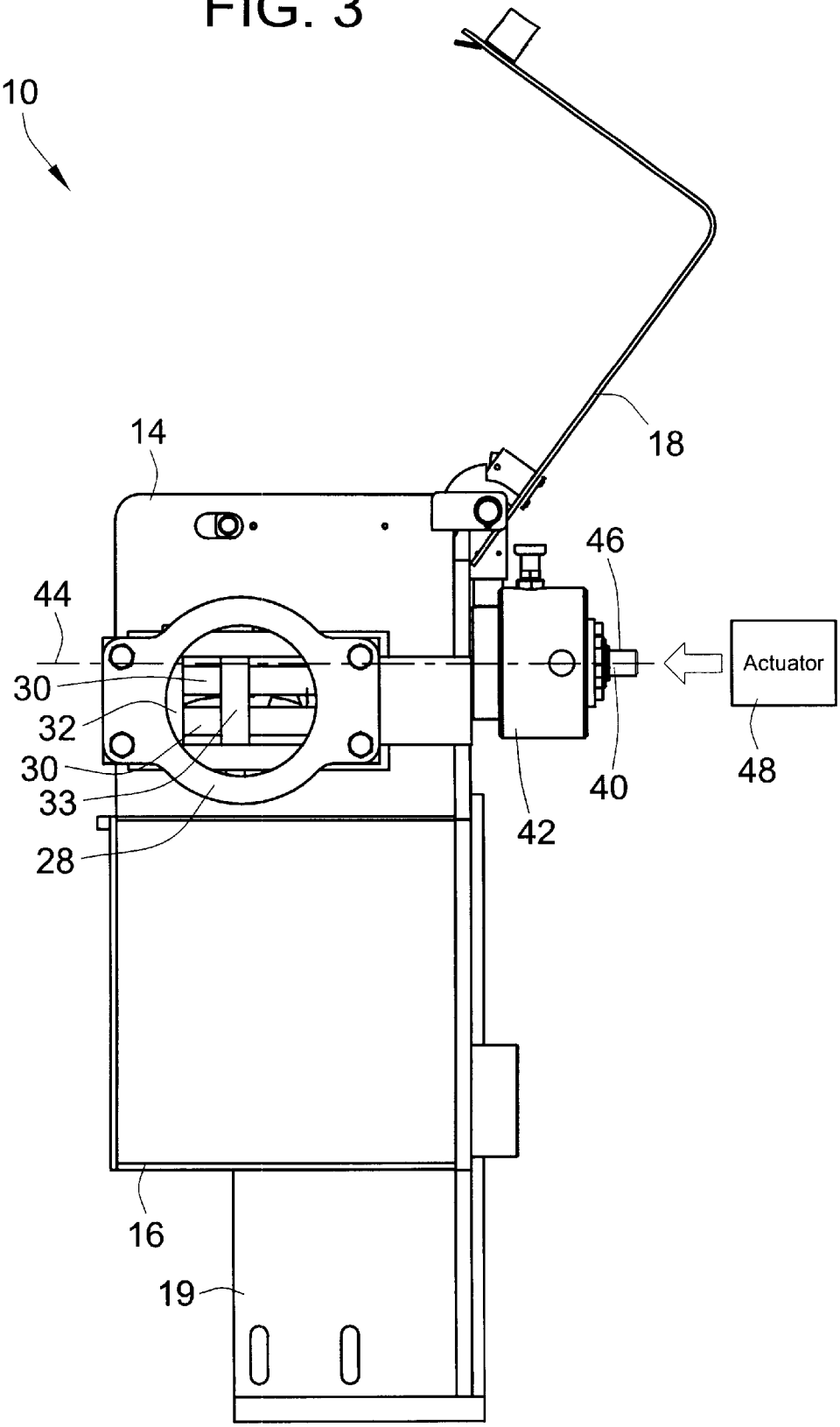
Figure 4:
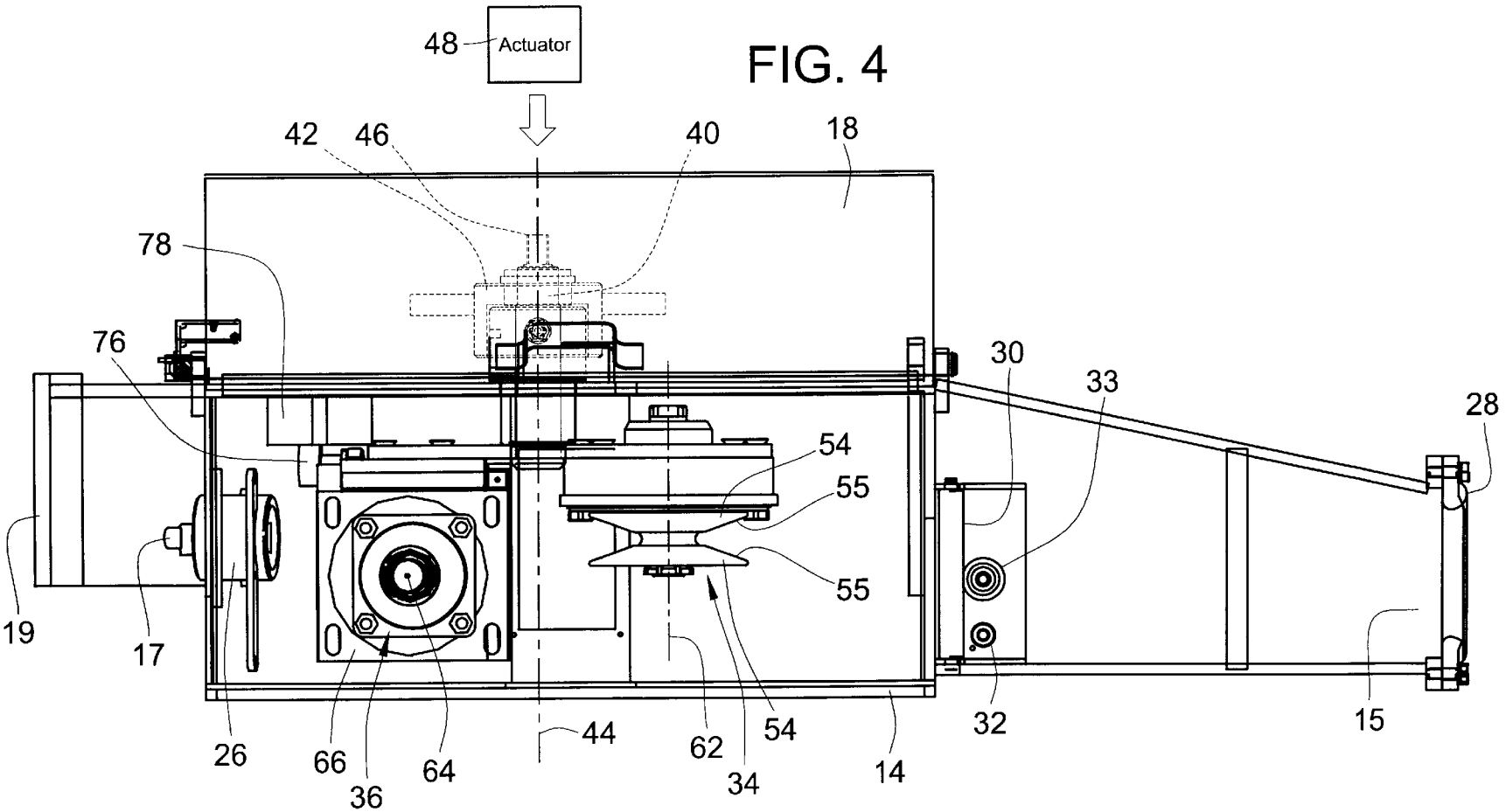

The descaler 20 includes a pair of sheaves or rollers 34, 36 that are carried upon a support assembly comprised of a rotatable carriage including roller support plate 38 and a drive shaft 40; and a stationary component comprising a bearing support hub 42 in the disclosed embodiment. The support plate 38 is affixed and cantilevered to the drive shaft 40. The drive shaft 40 projects through the housing 14 and is journalled to and supported for rotation by the bearing support hub 42 which is mounted along the outside of the housing 14. Referring to FIGS. 2 and 4, the rotational axis 44 of the drive shaft 40 is located between the rollers 34, 36 such that rotation of the drive shaft 40 causes the support plate 38 and the rollers 34, 36 to rotate in unison as shown generally in FIGS. 7–19. The drive shaft 40 includes a workable end 46 that is located preferably along the outside of the housing 14 to provide for attachment of the drive shaft 40 to a manual crank/lever that can be rotated manually, or alternatively an actuator 48 as schematically shown in FIGS. 3 and 4 which may take the form of an electrical motor, a fluid powered motor or cylinder, or other appropriately driven actuating mechanism. Leverage or gear reduction mechanism may be used between the actuator mechanism and the shaft 40 to reduce torque required to rotate the support plate assembly (e.g. a chain and sprocket connected to a hard crank).

Figure 5:
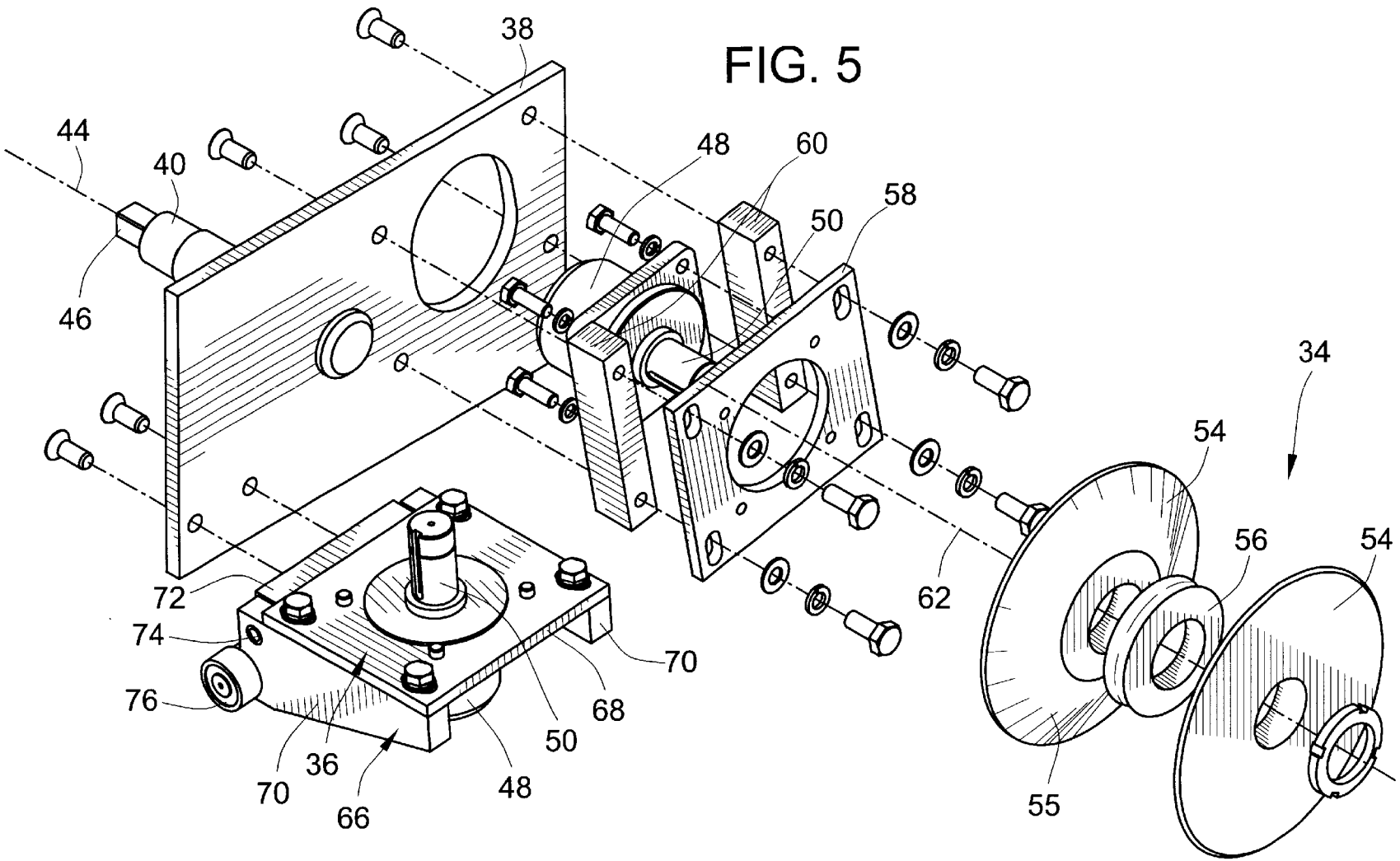
FIG. 5 is an exploded isometric assembly drawing of a roller support element as used in the wire descaler shown in the previous drawings.
Figure 6:
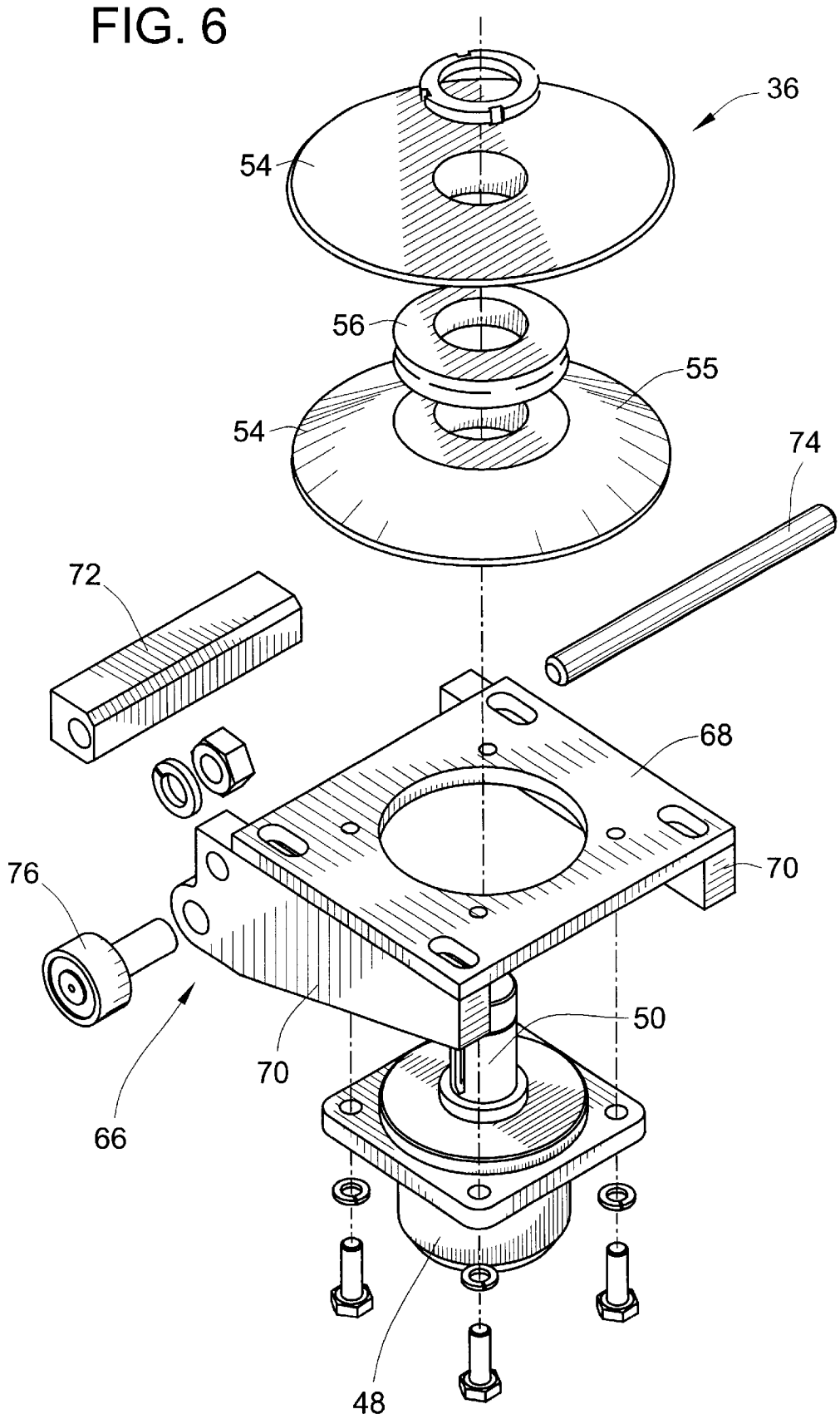
FIG. 6 is an exploded isometric assembly drawing of the pivoting support plate assembly for one of the rollers.
Figure 8:
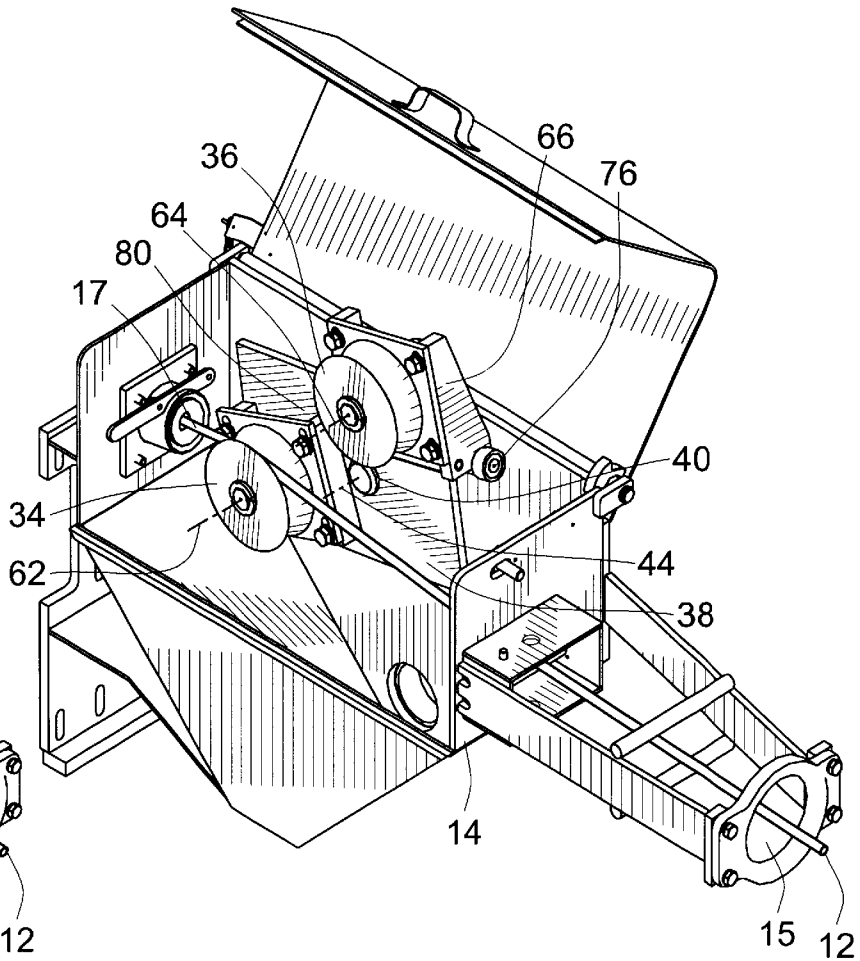
FIGS. 7–19 are isometric views of the wire descaler shown in FIG. 1 illustrating initial wire set up of the wire descaler and showing different sequential angular orientations of the rollers of the descaler as the wire descaler is being set up for operation.

As shown in FIGS. 5 and 6, each roller 34, 36 may include a shaft 50, a pair of disc-shaped sheave elements 54, and a carbide insert 56. The carbide insert 56 is adapted to engage the wire and is sandwiched between the sheave elements 54. The shaft 50 is journalled in a bearing housing such that each roller 34, 36 is freely rotatable relative to the bearing housing 52. The first roller 34 rotates about a first roller axis 62, while the second roller 36 rotates about a second roller axis 64.

In the preferred embodiment, the horizontal and vertical positions of the first roller 34 are fixed relative main support plate 38. The way in which the first roller 34 is mounted to the support plate 38 is illustrated in FIG. 5. As shown therein, the bearing housing 52 for the first roller 34 is fastened to a mounting plate 58 in turn is mounted in horizontal spaced relation to the main roller support plate 38. Spacing blocks 60 space the mounting plate 58 from the main roller support plate 38 for the first roller 34. In the preferred embodiment, when the main roller support plate 38 rotates about the drive shaft axis 44, the first roller 34 also rotates about the first drive shaft axis 44.

Referring to FIGS. 5 and 6, the bearing housing for the second roller 36 is fastened to a pivot plate assembly 66 such that the second roller 36 is pivotable relative to the first roller 34. The pivot plate assembly 66 includes a mounting plate 68, a pair of support arms 70, a pivot pin 74 and a hinge bracket 72. The bearing housing 52 for the second roller 36 is fastened to the mounting plate 68 and the support arms 70. The support arms 70 are spaced apart with one arm located on each end of the hinge bracket 72. The pivot pin 74 extends through holes in the arms 70 and through a center bore in the hinge bracket 72 to provide a pivot joint and thereby allow for pivoting of the second roller 36 relative to the main roller support plate 38.

The second roller assembly shown in FIGS. 5 and 6 also includes a cam follower in the disclosed form of a cam roller 76 that is mounted to one of the support arms 70 at a location offset from the pivot joint/pin 74. When the cam roller 76 is mechanically engaged or driven, it urges the second roller 36 and its supporting components to pivot and rotate about the pivot pin 74. In that regard, cam guide 78 (e.g. a rectangular block as shown, or an angled surface or an eccentric) is secured or provided along the inside of the housing 14 for engaging the cam roller 76 at a predetermined angular position of the rotatable support plate 38 to cause or assist in the pivoting of the second roller 36.

As can be readily appreciated by the foregoing description, rotation of the drive shaft 40 causes the roller support plate 38 and the rollers 34, 36 carried thereon to rotate in unison about the rotational axis 44 defined by the drive shaft 40. The second roller 36 also pivots relative to the first roller 34 through the provision of the supporting pivot plate assembly 66. This arrangement provides for a new way to set up the descaler 10 each time the leading end of a new wire coil must be feed through the wire descaler 10. This will be described in further detail below with reference to FIGS. 7–19.

Figure 7:
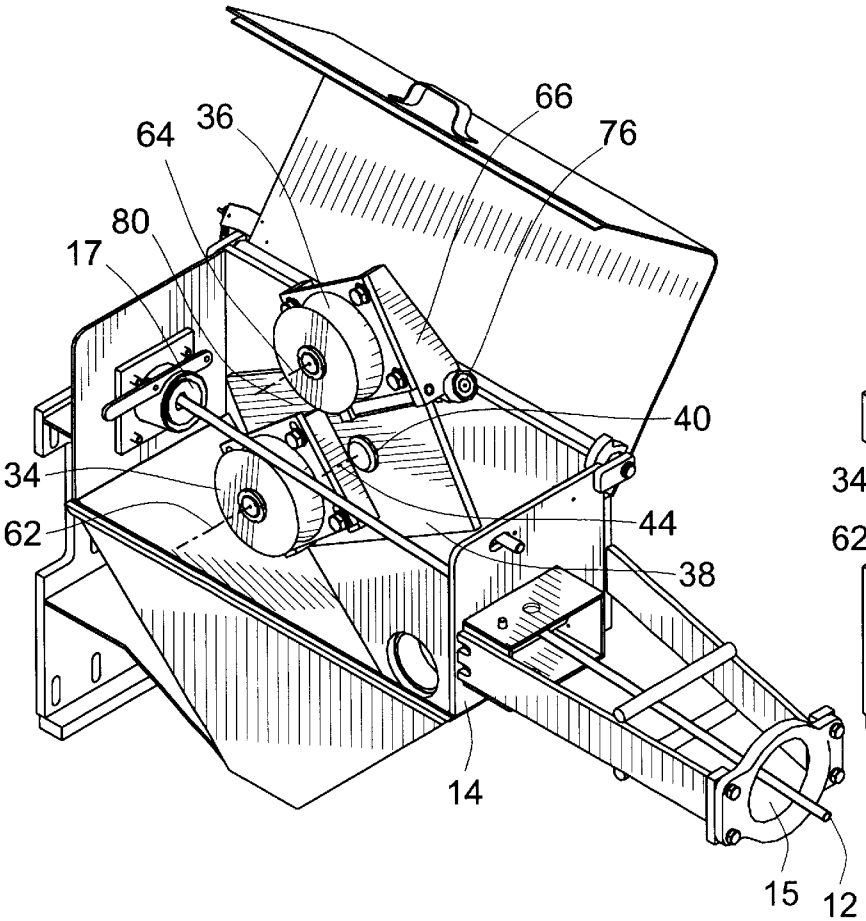
Figure 10:
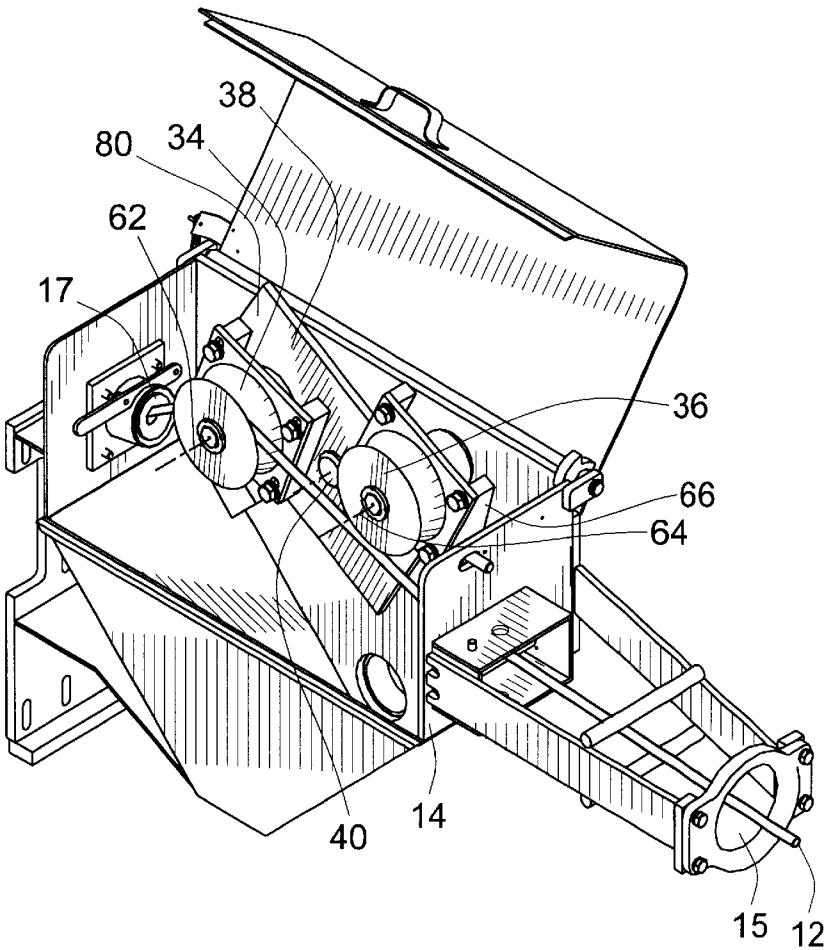
Figure 9:
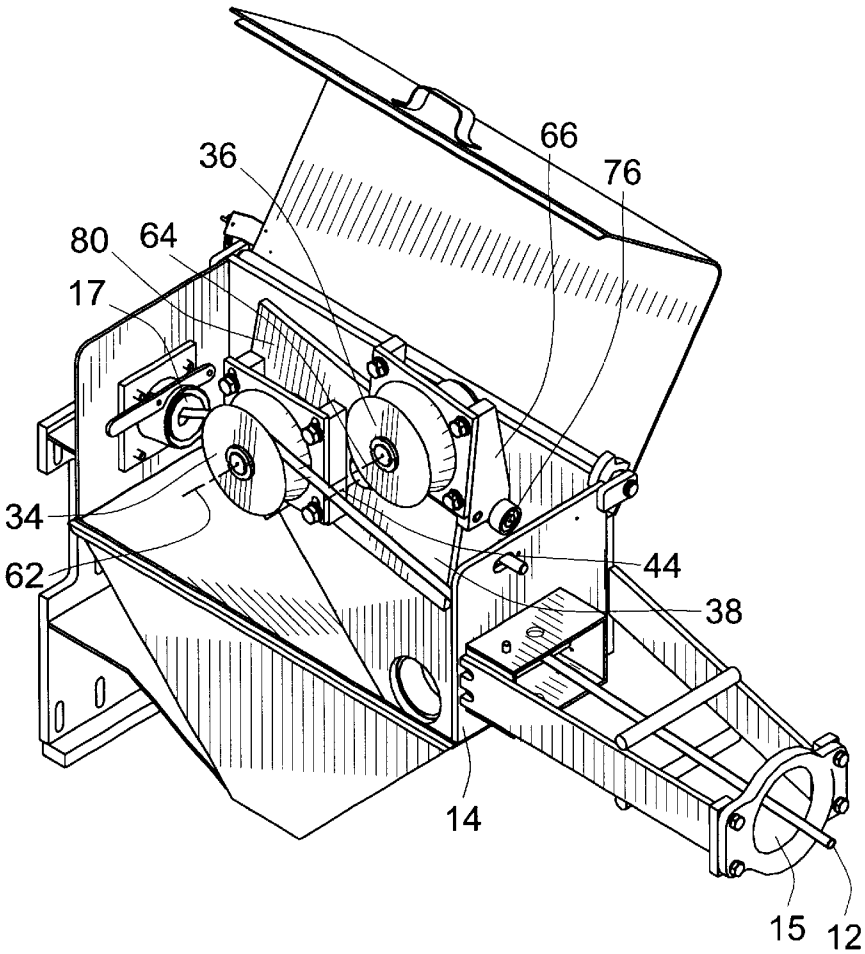
Figure 12:
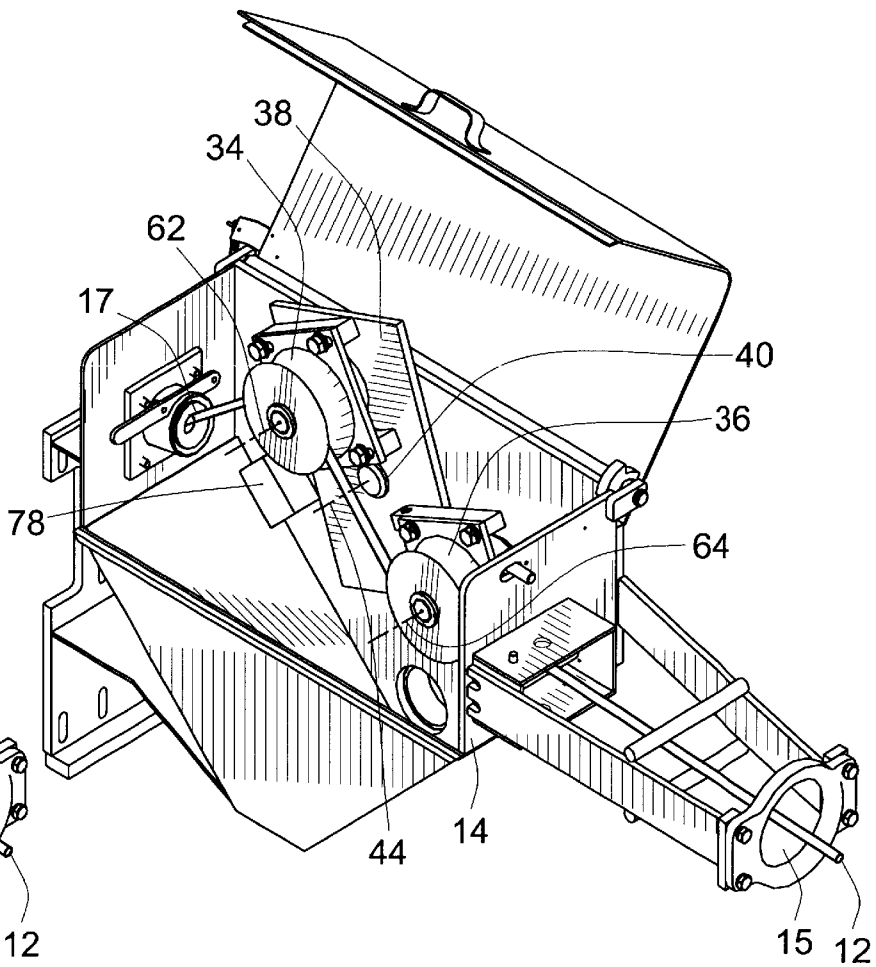
Figure 11:
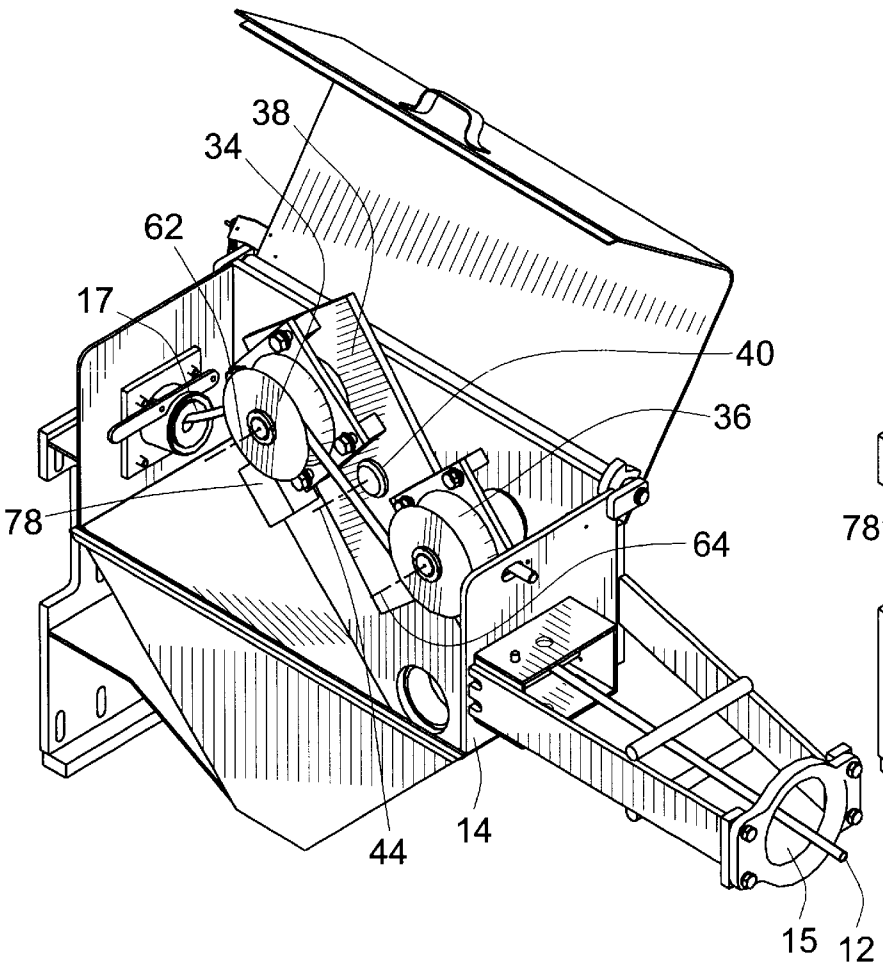
Figure 14:
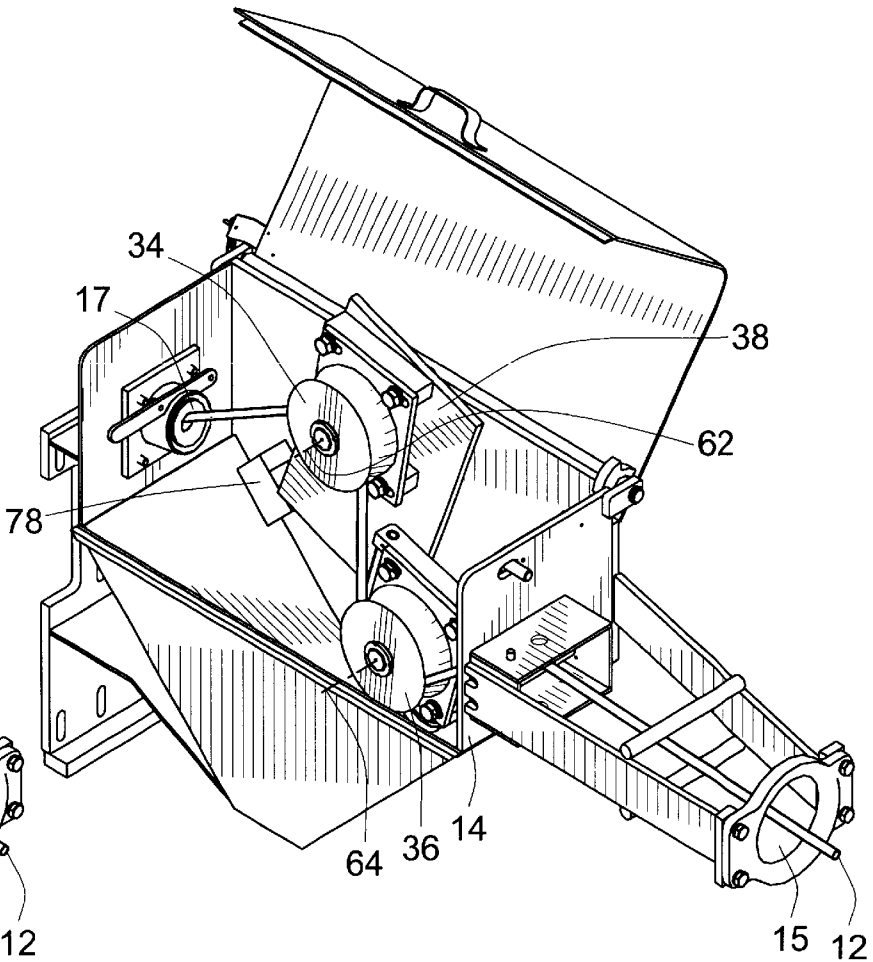
Figure 13:
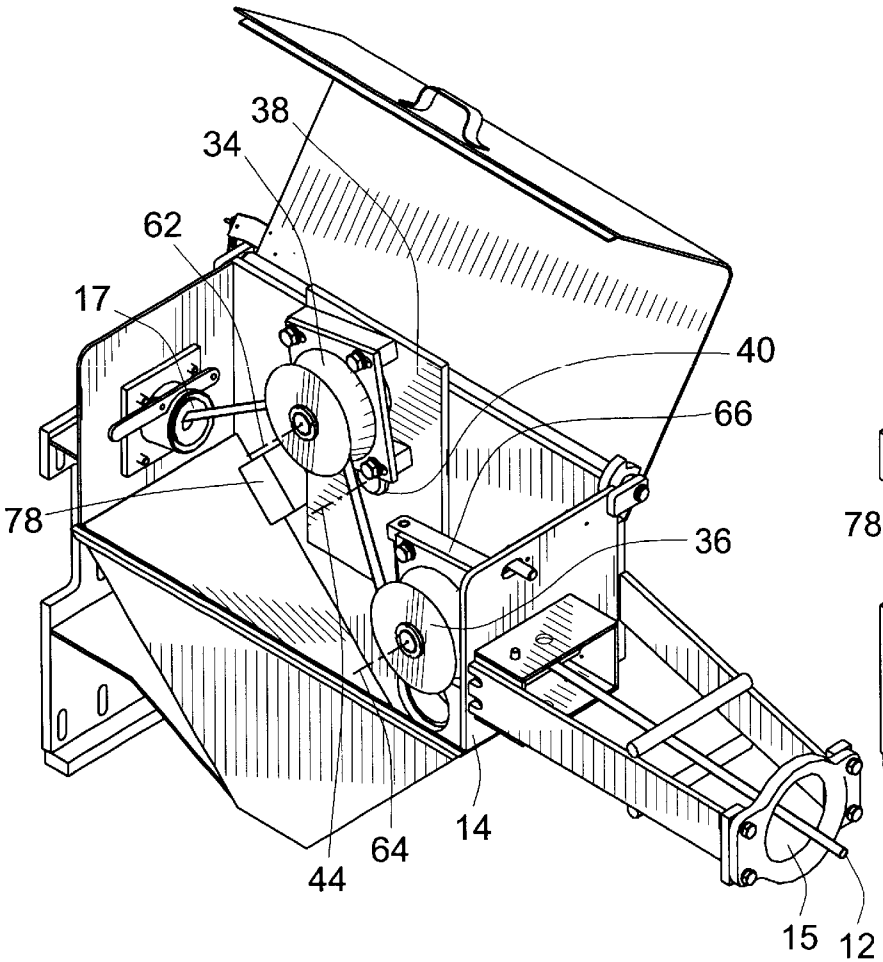
Figure 16:
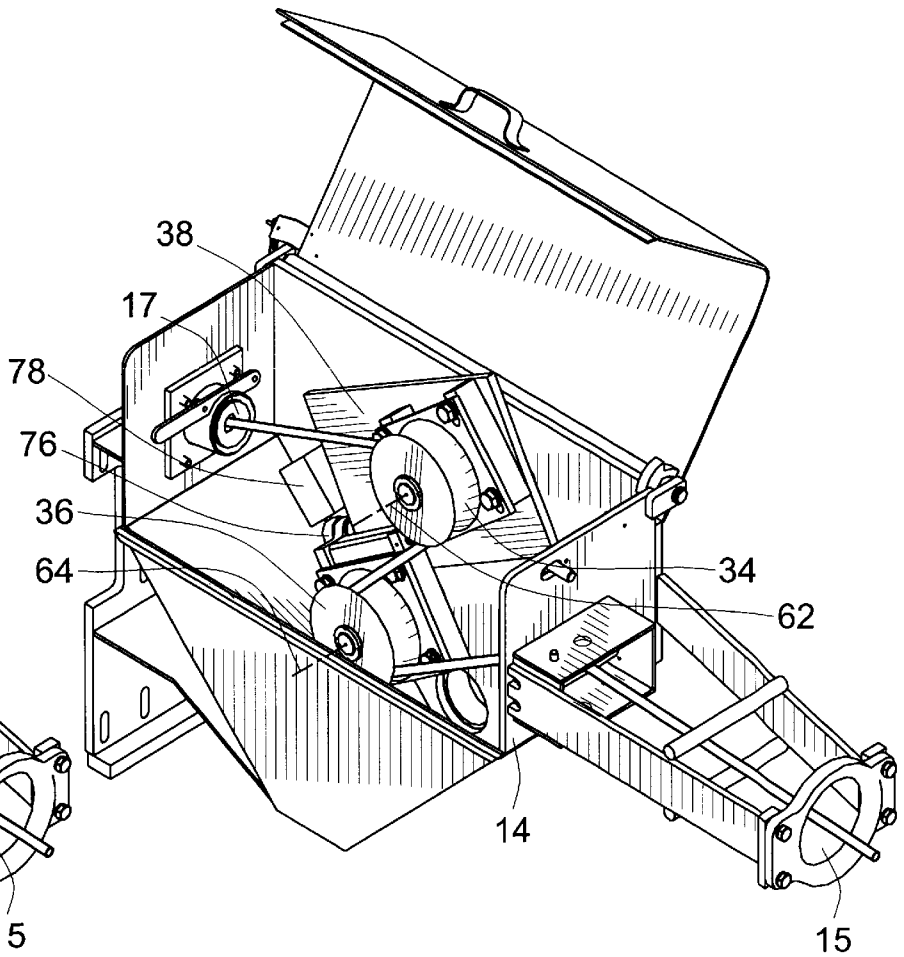
Figure 15:
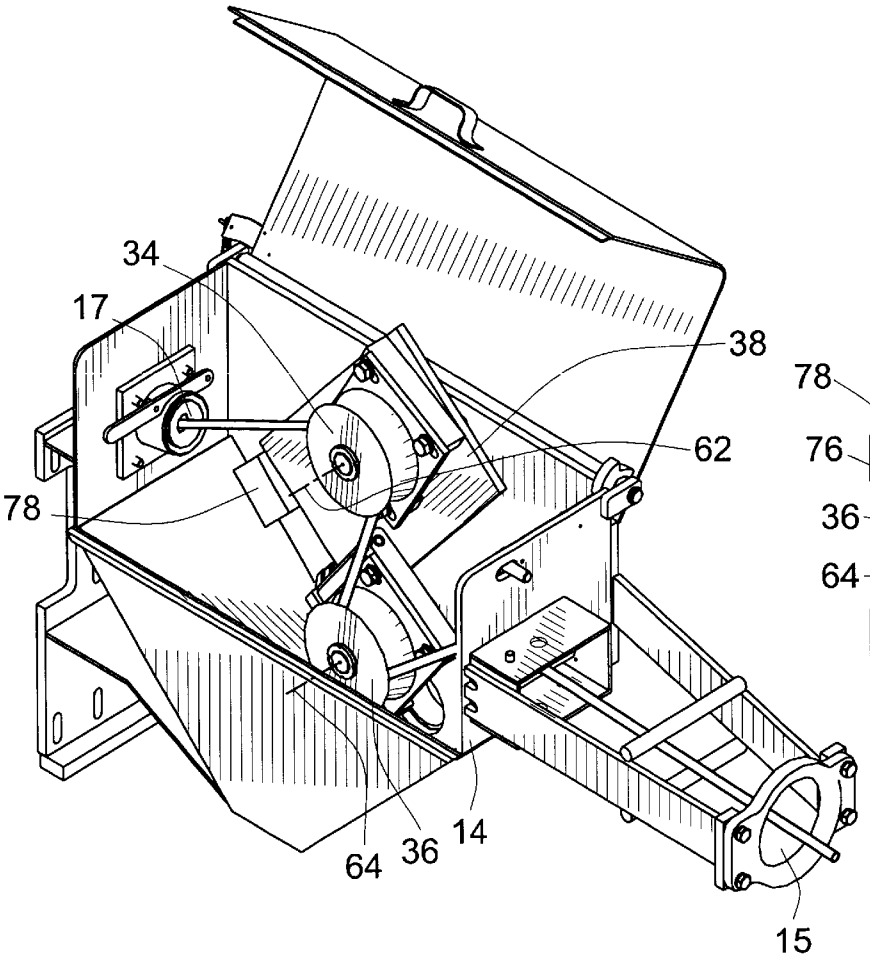

In operation, once a wire coil is exhausted and the leading end of a new coil is to be installed through the wire descaler 10, the rollers 34, 36 are first returned to an initial set up position as shown in FIG. 7. This is accomplished through rotation of the drive shaft 40. The removable pin 33 at the inlet 15 is also typically removed to facilitate feeding of wire into the housing 14 of the descaler 10. In this initial setup position shown in FIG. 7, the rollers 34, 36 are vertically spaced by a vertical gap 80 horizontally between the inlet 15 and the outlet 17. This allows for quick and easy manual insertion of the wire 12 through the inlet 15, through the vertical gap 80 between rollers 34, 36 and through the outlet 17 with little or no bending of the wire 12. The wire 12 is preferably received between the sheave elements 54 of the lower roller 34 for alignment purposes.

It should be noted that in the initial set up position as shown in FIG. 7 and prior to rotation of the drive shaft 40, the rotational axes 62, 64 of the rollers 34, 36 are aligned substantially parallel. This parallel alignment ensures that when the rollers 34, 36 are subsequently rotated about axis 44 via the drive shaft 40 (as shown in subsequent FIGS. 8–11), that the wire 12 is guided into and trapped between the respective sheave elements 54 for both of the respective rollers 34, 36. It will be appreciated that an exact or precise parallel relationship is not required to achieve installation of the wire with substantially no bending, and guiding and trapping of the wire 12 on the rollers 34, 36 between sheave elements 54, as the inner angled conical surface 55 of the sheave elements 54 and/or horizontal spacing of sheave elements 54 allow for some variation or slight skew (hence the term "substantially parallel"). The inner angled surface of the sheave elements 54 also provides a mechanism to accommodate and correct for slight bends in the wire that often occur as wire is pulled off a new wire coil and thereby ensure that the wire 12 does not slip off of the rollers 34, 36 as the descaler is being set up.

Once the leading end of the wire 12 is feed through the outlet 17, it is ordinarily pulled through the drawbox 24 (FIG. 1) and attached to a gripper mechanism (not shown) attached to the capstan 22 on the wire drawing machine 20. By securing the wire 12 to the gripper mechanism, this prevents the wire 12 from backfeeding through the outlet 17 and into the descaler housing 10 during initial set up of the descaler 10.

Once the leading end of the wire 12 is secured downstream of the outlet 17, then the descaler 10 can be set up in a single step by rotating the drive shaft 40 through about 200° of rotation, which in turn rotates the rollers 34, 36 in unison about the shaft axis 44 through about 200° of rotation as well. In the preferred embodiment, a single rotational movement of the drive shaft 40 in one direction is all that is necessary to complete set up of the descaler 10 into the working position shown in FIGS. 1 and 19. After the descaler 10 is located in the working position, the removable vertical guide roller 33 at the inlet 15 may be reinserted.

Figure 19:
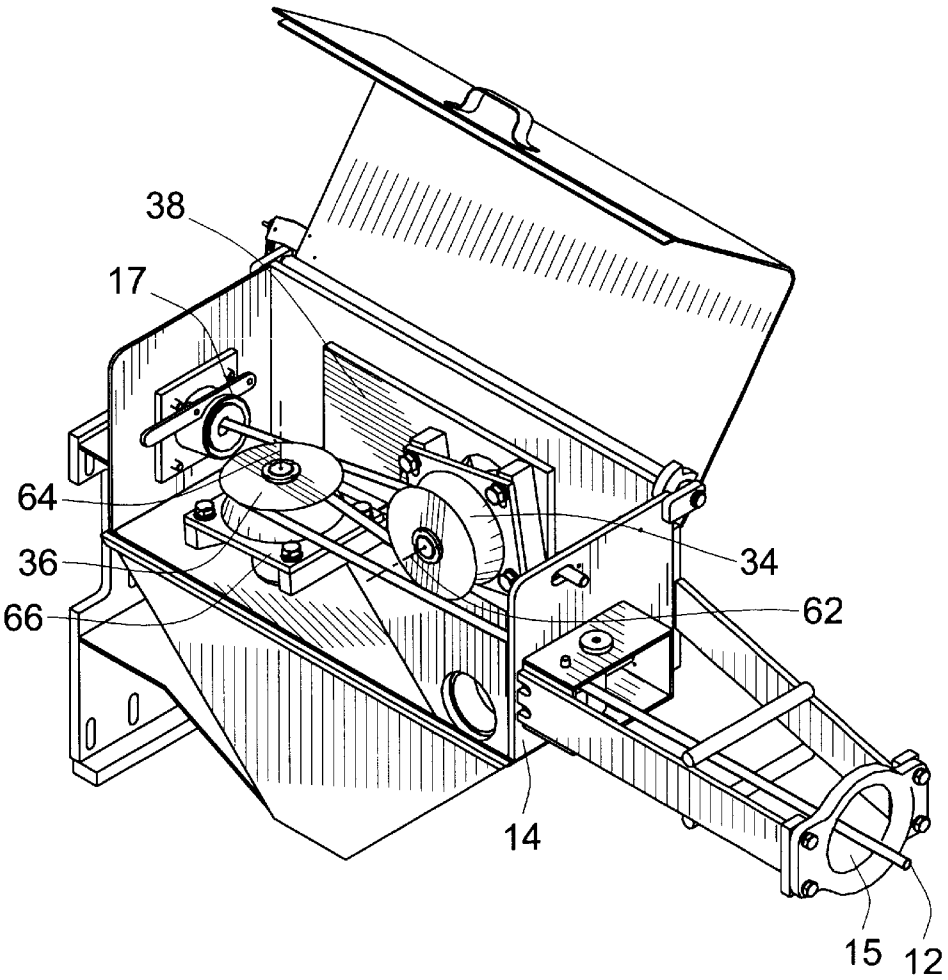

One of the advantages of the disclosed embodiment is that after the rollers 34, 36 have been rotated into the working position shown in FIGS. 1 and 19, the wire is typically pulled and naturally urged towards the non removable vertical guide roller 32. This allows for easy reinstallation of the removable vertical guide roller 33 with out the need to manipulate the wire at the inlet.

FIGS. 8–18 illustrate the descaler as rollers 34, 36 are rotated in unison via the drive shaft 40 from the initial set up position shown in FIG. 7 until the rollers 34, 36 eventually reach the working position illustrated shown in FIG. 19. As shown in FIGS. 7–16, the axes 62, 64 rollers 34, 36 remain substantially parallel for about the first 170° of rotation. Over this range of movement, the axes 62, 64 rollers 34, 36 remain substantially horizontally.

Figure 18:
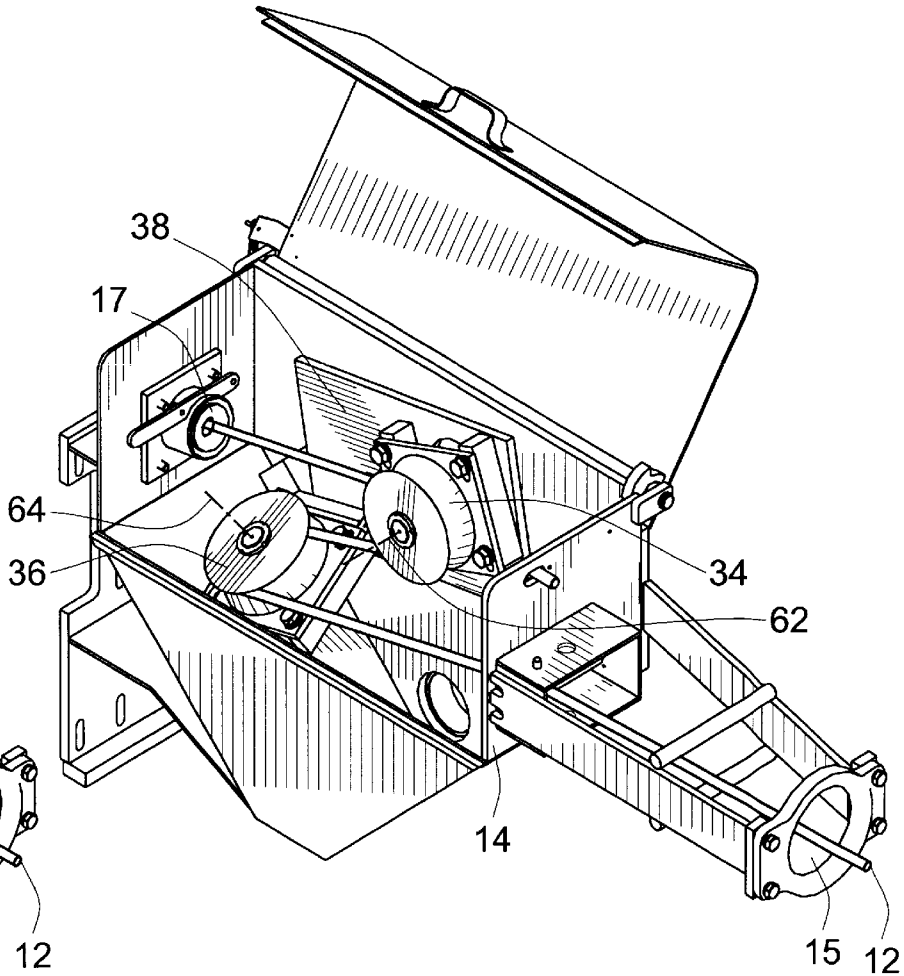
Figure 17:
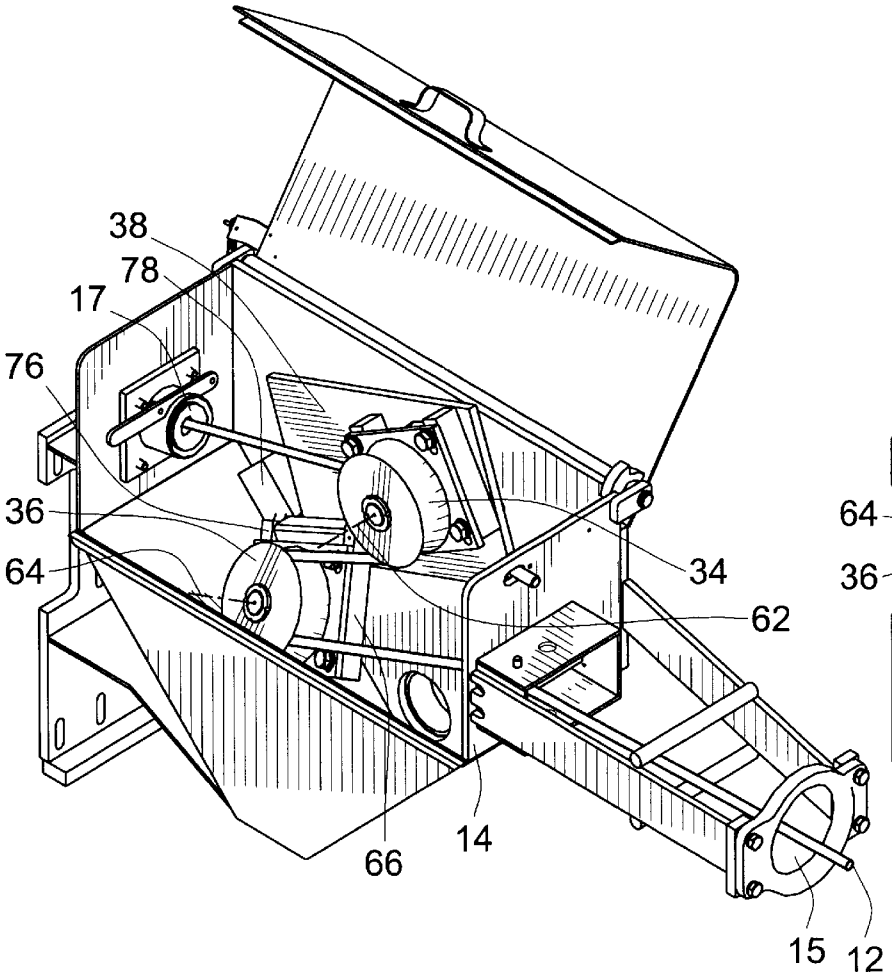

Then, over the next about 170° to about 200° of rotation the pivoting roller 36 and its pivot plate assembly 66 pivot until the axes 62, 64 of the rollers 34, 36 orient substantially perpendicular as shown in FIGS. 17–19. In the working position of FIG. 17, the axis 62 of the non-pivoting roller 34 remains substantially horizontal, while the axis 64 of the pivoting roller 36 is pivoted to a substantially perpendicular and substantially vertical orientation (see e.g. FIG. 2). While in the working position, the rollers 34, 36 are arranged to descale the wire as wire is pulled through the rollers 34, 36. The substantially perpendicular orientation of the roller axes 62, 64 causes the wire to be stretched or bent in two different directions, a different direction by each different roller 34, 36 sufficient to cause the brittle scale on the wire 12 to break and fall off.

It should be noted that as the rollers 34, 36 are rotated in unison under the action of the drive shaft 40 that tension is created in the wire 12. With the given arrangement of the rollers 34, 36 relative to the drive shaft axis 44 as shown, this created tension pulls the pivoting pivotable roller 36 and its pivot plate assembly 66 toward the first roller 34 (over the about 170° to about 200° of rotation shown in FIGS. 17–19). Thus wire tension created due to rotation of the drive shaft 40 or supporting element for the pivoting roller 36 is one means for translating the rotational motion into the pivoting action. Another means provided for achieving the same is a cam mechanism which engages at a predetermined angular orientation of the pivoting roller 36 and its pivot plate assembly 66. The cam mechanism comprises the cam follower shown as a roller 76 and the cam guide element 78. When the cam roller 76 strikes the cam guide element 78 at a predetermined angular position, the cam action drives and pivots the pivot plate assembly 66 and the roller 36 carried thereby about the pivot pin 74. In a preferred embodiment both the cam mechanism and the tension are used to pivot the second roller 36, although it will be appreciated that one of the means may be sufficient to provide the desired pivoting action. The cam mechanism, however, ensures that the pivot plate assembly does not simply drop down due to slack in the wire.

It is an advantage of the present invention that rotational motion is translated into pivoting action of the second roller 36 to bring the rollers 34, 36 into a spaced apart working position in which the roller axes 62, 64 are substantially perpendicular. In keeping with this advantage, it will therefore be appreciated that the present invention could also be applicable to descalers in which one of the rollers may also be located in a fixed position relative to the housing. Certain broader claims appended hereto are meant to include such other possibilities.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A wire descaler for descaling scale on wire, comprising:

a housing;

a support carriage supported by the housing for rotation relative to the housing about a carriage axis;

first and second rollers carried by the support carriage for rotation about first and second axes respectively, the first and second axes being offset from the carriage axis such that when the support carriage is rotated about the carriage axis, the first and the second rollers rotate in unison about the carriage axis, the first and second rollers being movable relative to each other between a set up position and a working position, wherein the first and second axes are substantially parallel in the set up position for facilitating loading of wire and are substantially perpendicular in the working position for facilitating descaling of wire;

wherein during initial wire set up of the descaler, rotation of the support carriage relative to the housing rotates the first and the second rollers in unison and automatically translates the first and second rollers from the set up position to the working position.

2. The wire descaler of claim 1 wherein when wire is fed through the rollers while in the set up position for initial setup of the descaler, wire tension is created in the wire during said rotation of the support carriage, said wire tension providing a force to translate the first and second rollers from the set up position to the working position.

3. The wire descaler of claim 1 further comprising a cam mechanism comprising cooperating elements operatively connected to at least one of the rollers and the housing, the cooperating elements of the cam mechanism engaging at an angular position of the support carriage to drive at least one of the rollers toward the working position.

4. The wire descaler of claim 1 wherein the first roller is fixed relative to the support carriage and the second roller is pivotally mounted to the support carriage for pivoting movement relative thereto.

5. The wire descaler of claim 1 wherein the support carriage comprises an input shaft and a roller support plate, the roller support plate carrying the first and second rollers, the input shaft being journalled to a bearing housing mounted on the housing.

6. The wire descaler of claim 5 further comprising an actuator mounted to the input shaft, a single rotary action of the actuator rotating the first and second rollers in unison and automatically translating the first and second rollers from the set up position to the working position.

7. The wire descaler of claim 1 wherein the first and second rollers are vertically spaced in the set up position and are horizontally spaced in the working position.

8. The wire descaler of claim 7 wherein wire when fed through the rollers the wire is free of tension and vertically spaced between the first and second rollers in the set up position and is biased to a state of tension in the working position.

9. A wire descaler for descaling scale on wire, comprising:

a housing;

a bearing support hub mounted to the housing;

a roller support plate inside the housing;

an input shaft mounted to the roller support plate, the input shaft being journalled to the bearing support hub such that the roller support plate and the input shaft rotate relative to the housing about an input axis;

a first roller mounted to the roller support plate offset from the input axis;

a second roller pivotally mounted to the roller support plate offset from the input axis and in spaced relation to the first roller with the input axis between the first and second rollers; and wherein when wire is fed through the rollers for set up of the descaler, rotation of the input shaft thereby rotates the first and second rollers in unison with the support plate and also pivots the second roller relative to the first roller as the first and second rollers rotate in unison.

10. The wire descaler of claim 9 wherein when wire is fed through the rollers while in the set up position for initial setup of the descaler, wire tension is created in the wire during said rotation of the roller support plate, said wire tension providing a force to pivot the second roller.

11. The wire descaler of claim 9 further comprising a cam mechanism comprising a cam follower operatively connected the second roller and a cam guide mounted to the housing, the cam follower engaging the cam guide at an angular position of the roller support plate to drive the second roller toward a working position in which respective axes of the first and second rollers are substantially perpendicular.

12. The wire descaler of claim 9 further comprising an actuator mounted to the input shaft, a single rotary action of the actuator rotating the first and second rollers in unison and automatically translating the first and second rollers from a set up position in which respective axes of the first and second rollers are substantially parallel to a working position in which respective axes of the first and second rollers are substantially perpendicular.

13. The wire descaler of claim 9 wherein the first and second rollers are vertically spaced in a set up position in which respective axes of the first and second rollers are substantially parallel and are horizontally spaced in a working position in which respective axes of the first and second rollers are substantially perpendicular.

14. The wire descaler of claim 13 wherein wire when fed through the rollers the wire is free of tension and vertically spaced between the first and second rollers in the set up position and is biased to a state of tension in the working position.

15. A wire descaler for descaling scale on wire, comprising:

a housing;

a first roller supported by the housing for rotation about a first axis;

a second roller supported by the housing for rotation about a second axis, a roller support element connecting at least the second roller to the housing, the roller support element being rotatable relative to the housing about a third axis offset from said second axis, wherein rotation of the roller support element rotates the second roller about the third axis, the second roller being pivotally mounted to the roller support element for a pivoting movement about a fourth axis, the second roller pivoting between a set up position wherein the first and second axes are substantially parallel for facilitating loading of wire and a working position wherein the first and second axes are substantially perpendicular for facilitating descaling of wire; and means for translating said rotation of the roller support element into pivoting movement of the second roller toward the working position such that as the roller support element rotates about the third axis over a range of movement, the second roller simultaneously pivots about the fourth axis.

16. The wire descaler of claim 15 wherein said translating means comprises wire tension that is created when wire is fed through the rollers while in the set up position for initial setup of the descaler and when rotation of the roller support element occurs.

17. The wire descaler of claim 15 wherein said translating means comprises a cam mechanism comprising cooperating elements operatively connected to the second roller and the housing, the cooperating elements of the cam mechanism engaging at an angular position of the roller support element to drive the second rollers toward the working position.

18. The wire descaler of claim 15 wherein both of the first and second rollers are mounted to the roller support element, wherein rotation of the roller support element rotates the first and second rollers about the third axis in unison.

19. The wire descaler of claim 18 further comprising an actuator mounted to the roller support element, a single rotary action of the actuator rotating the first and second rollers in unison and automatically translating the first and second rollers from the set up position to the working position.

20. The wire descaler of claim 15 wherein the first and second axes are substantially parallel in a set up position for facilitating loading of wire and are substantially perpendicular in a working position for facilitating descaling of wire when wire is pulled through the descaler.

21. The wire descaler of claim 20 wherein the first and second axes are aligned substantially horizontal in the set up position, and wherein the first axis is substantially horizontal and the second axis is substantially vertical in the working position.

* * * * *